United States Patent [19]

Forker et al.

[11] Patent Number: 4,826,447

[45] Date of Patent: May 2, 1989

[54] SNAP BOARD RETAINER

[75] Inventors: Donald L. Forker; Gregory E. Skipper, both of Harrisburg, Pa.

[73] Assignee: AMP Incorporated, Harrisburg, Pa.

[21] Appl. No.: 192,254

[22] Filed: Apr. 25, 1988

[51] Int. Cl.[4] ..... H01R 13/639

[52] U.S. Cl. ..... 439/328

[58] Field of Search ..... 439/325, 327, 328, 326, 439/350, 357, 79, 80, 629, 630, 633

[56] References Cited

U.S. PATENT DOCUMENTS

| | | | |
|---|---|---|---|
| Re. 32,559 | 12/1887 | Fedder et al. | 439/325 |
| 3,573,706 | 4/1971 | Haberlen | 439/328 |
| 3,970,353 | 7/1976 | Kaufman | 439/325 |
| 4,498,722 | 2/1985 | Fedder et al. | 439/260 |
| 4,579,411 | 4/1986 | Cobaugh et al. | 439/327 |

FOREIGN PATENT DOCUMENTS

| | | | |
|---|---|---|---|
| 0052462 | 5/1982 | European Pat. Off. | 439/325 |

*Primary Examiner*—Neil Abrams
*Assistant Examiner*—Khiem Nguyen
*Attorney, Agent, or Firm*—Allan B. Osborne

[57] ABSTRACT

The disclosure relates to a retainer for locking a printed circuit board into an edge connector having side ears with an aperture through each ear. The retainer includes two pairs of legs extending from a body in a first direction with flanges on the distal portion of each leg. The inner pairs of legs extend through the aperture in each of the ears with the flanges extending back over the ears. The outer legs extend around the ears with the flanges extending back over the ears to secure the retainer to the ears. The retainer includes a third pair of legs which extends outwardly from the body in a direction opposite to the above mentioned pairs of legs, one of these legs having a laterally extending pin and the other of these legs having an aperture for lockingly receiving the pin therein. The pin is disposed through an aperture in a circuit board to lock the board in the connector.

14 Claims, 5 Drawing Sheets

SNAP BOARD RETAINER

BACKGROUND OF THE INVENTION

1. Field of the Invention

This invention relates to a device for removably retaining printed circuit boards in connectors and, more specifically, to a mechanical retainer for removably locking a printed circuit board in position within a card edge connector.

2. Brief Description of the Prior Art

It is often necessary to transfer signals in current paths on printed circuit boards to locations external of the board, such as other printed circuit boards for various purposes. Edge connectors have been devised to assist in performance of such functions, examples of which are shown in the patents of Fedder et al. U.S. Pat. Nos. 4,487,468, Fedder et al. 4,498,722 and Cobaugh, et al. 4,579,411. In such edge connectors of the prior art, the connector assembly is generally slid over the edge of the printed circuit board and fingers in the connector make contact with appropriate conductive paths on the circuit board. The fingers are then soldered to the conductive paths on the circuit board. Such solder connections have proved to be unreliable in that the solder joints often come apart due to movement between the circuit board and the contact fingers of the connector. It has therefore been necessary to provide some type of mechanical retainer in addition to the solder connection to secure the circuit board to the connector. The above patents set forth examples of such retainers.

The prior art retainers have been relatively inefficient in that they utilized screws and/or roll pins and the like which were relatively labor intensive in order to secure the circuit board to the connector. It is therefore apparent that a simple device which can rapidly releasably lock the printed circuit board in the connector is desirable.

SUMMARY OF THE INVENTION

In accordance with the present invention, the above described problem of the prior art is minimized and there is provided a retainer for locking a printed circuit board in an edge connector which is simple and easily and rapidly operated to provide a less labor intensive device as compared with the prior art.

Briefly, in accordance with the present invention, there is provided an electrical edge connector having ears extending from two opposite ends with apertures through the ears. A circuit board retainer, formed from resilient plastic, preferably nylon, is secured to each of the ears. Each retainer includes a pair of outwardly biased inner fingers, each inner finger having an outwardly extending flange portion and a pair of inwardly biased outer fingers, each other finger having an inwardly extending flange portion. The flange portions all have a flat portion, all of the flat portions lying along a straight line. The fingers are all generally parallel to each other and secured to a body portion of the retainer. A pair of spaced apart legs extends from the retainer body in a direction opposite to the fingers, one of the legs having an aperture extending therethrough at the end thereof remote of the body. The other leg includes a pin portion extending toward the aperture, the pin portion having a ridge for releasably snapping onto a retentive ridge within the aperture in the leg or other similarly functioning mechanism.

In operation, the retainers are locked into the ears of the connector by first forcing the inner fingers through the apertures in the connector ears and permitting the flanges thereon to move outwardly to lock onto the outer surface of the ears. The outer legs are then moved inwardly to lock onto the outer surface of the ears, thereby securing the retainer to the connector ears. The printed circuit board is then positioned in the connector in standard manner and the pin portion is passed through an aperture in the board and locked in the aperture in the opposing leg to lock the board in place in the connector.

It can be seen that the circuit board is retained in position by a simple releasable locking of the pin into the aperture. The circuit board is easily removed from the connector by removing the pin from the aperture and then sliding the circuit board out of the connector. No tools, complex or substantial time consuming operations are required.

DESCRIPTION OF THE PREFERRED EMBODIMENT

Figure 1:
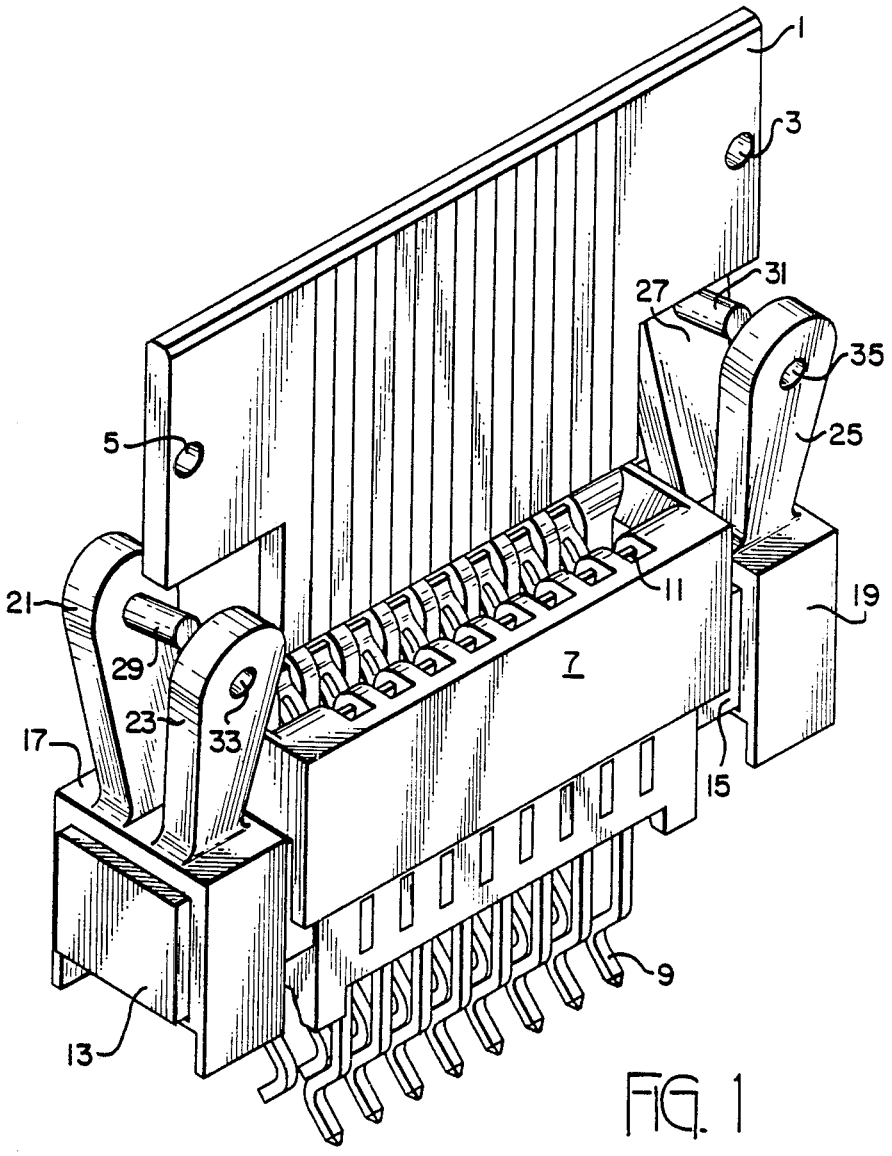
FIG. 1 is a perspective view of a retainer in accordance with the present invention secured to an electrical edge connector prior to entry of a printed circuit board into the connector.
Figure 2:
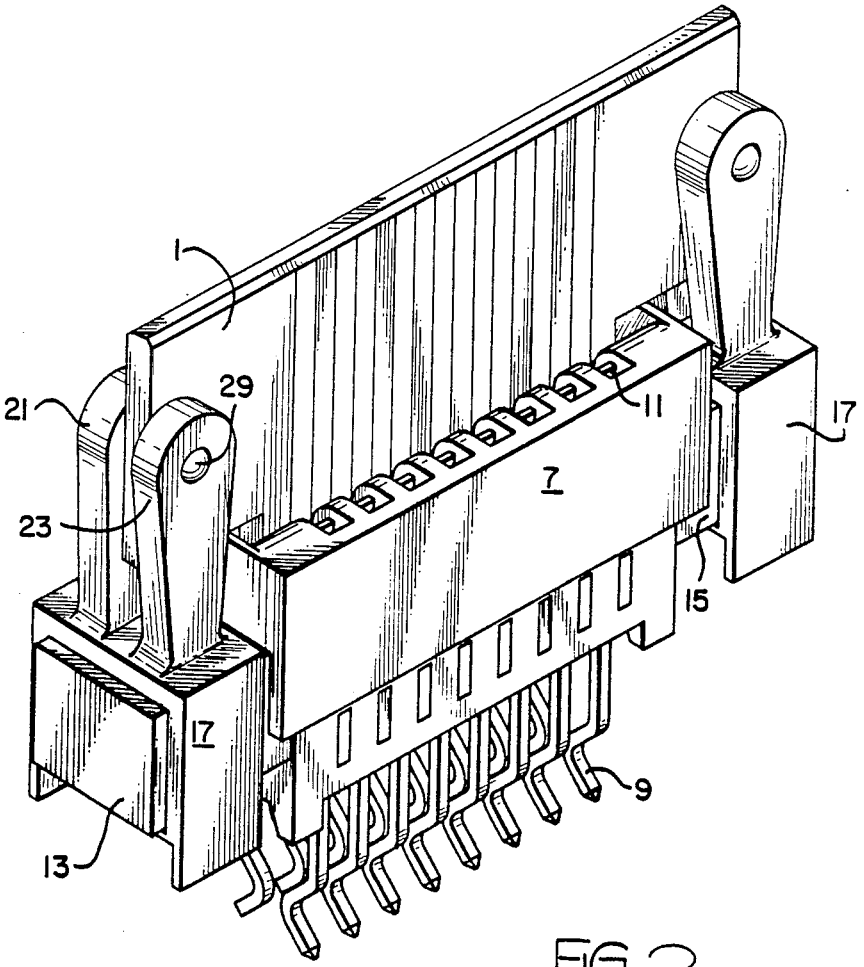
FIG. 2 is a view as in FIG. 1 after releasably locking the printed circuit board in the connector with the retainer.

Referring now to FIG. 1, there is shown a printed circuit board 1 having apertures 3 and 5 therein. Also shown is an electrical edge connector 7 having connection fingers 9 extending from the bottom side thereof and separable interface 11 extending from the top side thereof. The connector 7 also includes a pair of mounting ears 13 and 15 extending outwardly from the two sides thereof. Retainers 17 and 19 are secured in the ears 13 and 15 respectively for locking the circuit board 1 in the connector 7. As viewed in FIG. 1, the legs 21 and 23 of the retainer 17 and the legs 25 and 27 of the retainer 19 are spaced apart so that the pins 29 and 31 on legs 21 and 27 respectively are spaced from the apertures 33 and 35 on legs 23 and 25 respectively to provide space for the circuit board 1 to enter into the connector 7. When the circuit board 1 is properly secured in the connector 7, the pins 29 and 31 will be aligned with the apertures 5 and 3 and the apertures 33 and 35 respectively. As can be seen in FIG. 2, when the pins 29 and 31 are pushed through the apertures 5 and 3 and the apertures 33 and 35, the circuit board 1 will be locked in the connector 7 for reasons which will be provided in greater detail hereinbelow.

Figure 3:
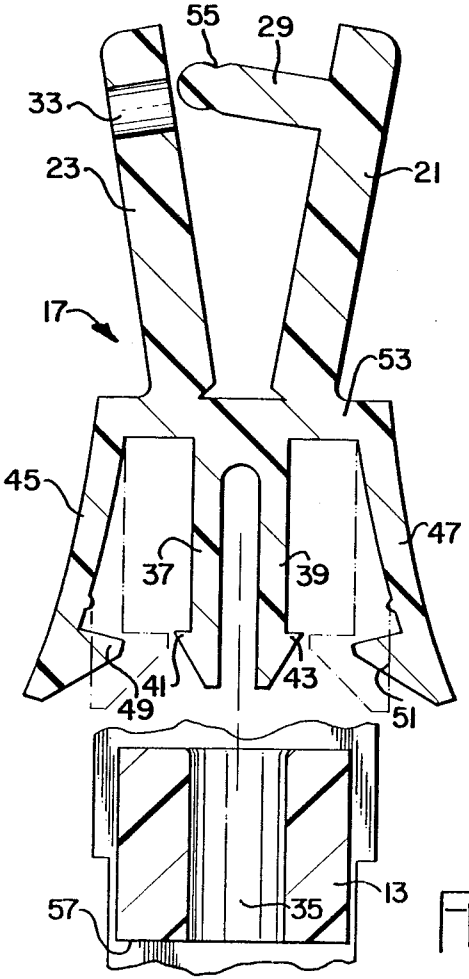
FIG. 3 is a cross sectional view of the retainer in accordance with the present invention prior to mounting in the connector ears.

Since the retainers 17 and 19 are identical, only one will be described. Referring now to FIG. 3, there is shown the ear 13 of the electrical edge connector 7, said ear having an aperture 35 extending therethrough. The circuit board retainer 17 is formed from resilient plastic, preferably nylon. The retainer 17 includes a pair of outwardly biased inner fingers 37 and 39, each inner finger having an outwardly extending flange portion 41 and 43 and a pair of inwardly biased outer fingers 45 and 47, each outer finger having an inwardly extending flange portion 49 and 51. The flange portions all have a flat portion facing toward the body portion 53 of the retainer 17, all of the flat portions lying along a straight line. The fingers 37, 39, 45 and 47 are all generally parallel to each other and secured to the body portion 53 of the retainer. A pair of spaced apart legs 23 and 21 extends from the retainer body portion 53 in a direction therefrom opposite to that of the fingers, one of the legs 23 having an aperture 33 with a retentive ridge 34 therein (shown also in FIG. 6) extending therethrough at the end thereof remote from the body. The other leg 21 includes a pin portion 29 extending toward the aperture 33, the pin portion having a depression 55 for releasably snapping onto the retention ridge 34 in the aperture in the leg 23. This function could also be accomplished by making the pin 29 of similar shape to pins 37, 39 and compliant and having these pins extend through the aperture 33 to the exterior of the legs 23, retention being accomplished in the same manner as described herein with respect to the pins 37 and 39.

Figure 4:
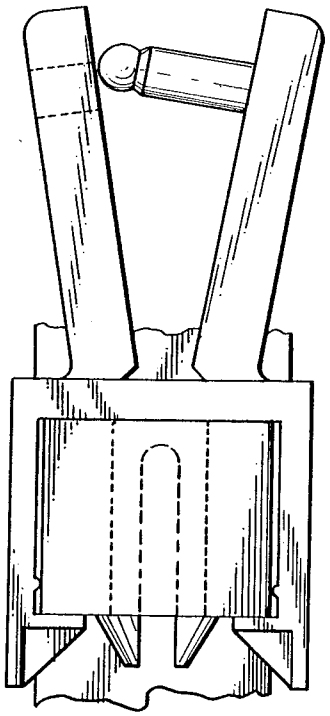
FIG. 4 is a view as in FIG. 3 after mounting of the retainer in the connector ears.

In operation, as shown in FIGS. 3 and 4, the retainer 17 is locked into the ear 13 of the connector 7 by first forcing the inner fingers 37 and 39 through the aperture 35 in the connector ear and permitting the flanges 41 and 43 thereon to move outwardly to lock onto the bottom surface 57 thereof. The outer legs 45 and 47 are then moved over the outer surface of the ear 13 with the flanges 49 and 51 thereof then being moved inwardly over the bottom surface 57, thereby securing the retainer to the connector ear. This arrangement is shown in FIG. 4.

Figure 6:
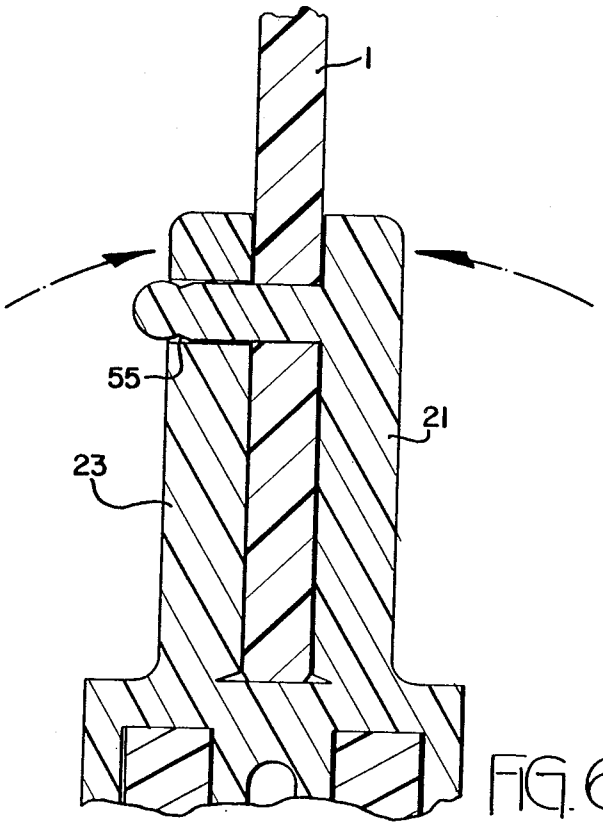
FIG. 6 is a view as in FIG. 5 after retention of the circuit board in the connector.
Figure 5:
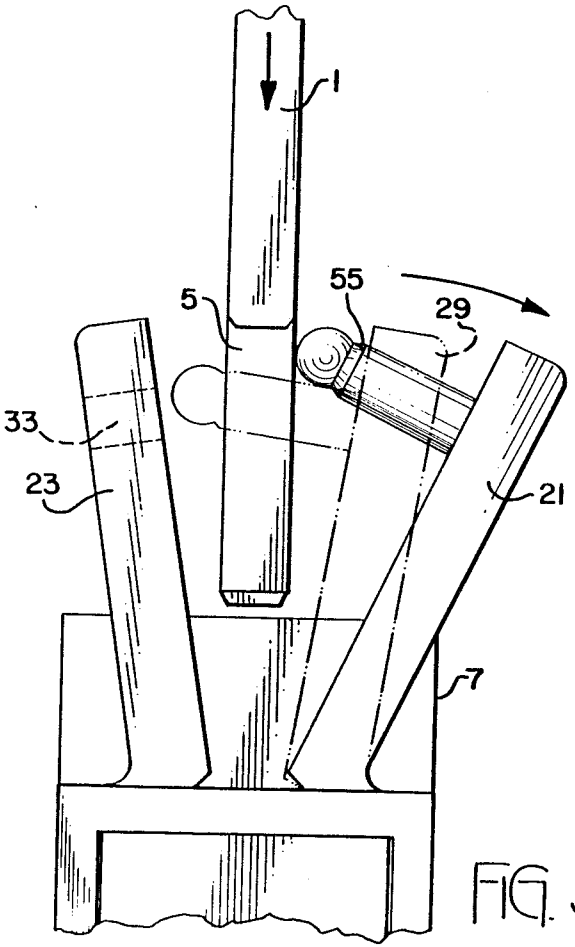
FIG. 5 is a cross sectional view of the mounted retainer as shown in FIG. 4 during entry of a circuit board into the connector.

The legs 21 and 23 are then moved apart as shown by the arrow in FIG. 5 and the printed circuit board 1 is then moved downwardly and positioned in the connector 7 in standard manner as explained hereinabove. The pin portion 29 is passed through the aperture 5 in the circuit board 1 by moving the leg 21 in a counterclockwise direction as shown in FIG. 6 and the end of the pin is locked in the aperture 33 in the opposing leg 23 by moving the leg 23 in a clockwise direction as shown in FIG. 6 to lock the circuit board in place in the connector 7. This is accomplished by a locking action between depression 55 and the ridge 34 within the aperture 33.

To remove the circuit board 1 from the connector 7, it is merely necessary to pull the legs 21 and 23 apart, thereby causing the pin portion 29 to unlock from the aperture 33, the pin also being withdrawn form the aperture 5 in the board. The board is then moved vertically to remove it from the connector 7.

Figure 7:
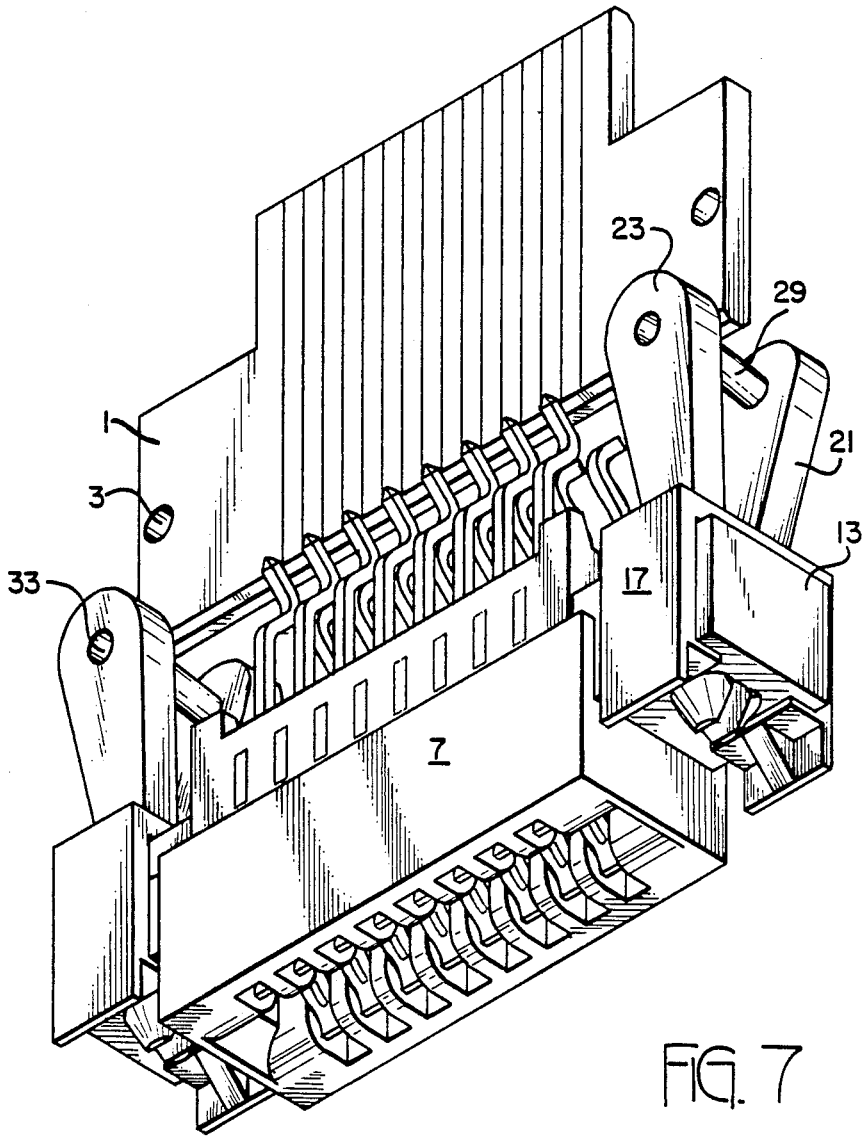
FIG. 7 is a view as in FIG 1, showing entry of the circuit board on the side of the connector having connection fingers as opposed to the connection terminals.

Referring now to FIG. 7, there is shown the same embodiment as in FIG. 1 except that the retainers 17 and 19 have been rotated by 180 degrees in the ears 13 and 15 with the board 1 being positioned between the connection fingers 9 for connection thereto. The retainers operated in the same manner set forth hereinabove.

It can be seen that the circuit board is retained in position by a simple releasable locking of the pin into the aperture in addition to the solder connections therein. The circuit board is permanent and removed from the connector only by first desoldering the solder connections, removing the pin from the aperture and then sliding the circuit board out of the connector. No tools, complex or substantial time consuming operations other than the desoldering operation are required.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A retainer for joining a printed circuit board having an apertured ear to an edge connector, comprising:
   (a) a body having
   (b) a first pair of substantially parallel legs extending outwardly from the said body in a first direction and having a flange at the distal end thereof for securing to said ear, said flange on each leg extending away from each other; and
   (c) a second pair of substantially parallel legs extending outwardly from said body in said first direction and having a flange at the distal end thereof for securing to said ear, said flange on each said leg extending towards each other; and
   (d) circuit board locking means extending outwardly from said body in a direction opposite to said first direction for locking onto a circuit board.

2. A retainer as set forth in claim 1 wherein said first pair of legs is disposed within said second pair of legs.

3. A retainer as set forth in claim 1 wherein said first pair of legs is disposed within said second pair of legs.

4. A retainer as set forth in claim 1 wherein said circuit board locking means comprises a pair of legs rotatable about a pivot, one of said legs including a pin extending normal thereto, the other said leg comprising an aperture for lockingly receiving said pin therein.

5. A retainer as set forth in claim 1 wherein said circuit board locking means comprises a pair of legs rotatable about a pivot, one of said legs including a pin extending normal thereto, the other said leg comprising an aperture for lockingly receiving said pin therein.

6. A retainer as set forth in claim 2 wherein said circuit board locking means comprises a pair of legs rotatable about a pivot, one of said legs including a pin extending normal thereto, the other said leg comprising an aperture for lockingly receiving said pin therein.

7. A retainer as set forth in claim 3 wherein said circuit board locking means comprises a pair of legs rotatable about a pivot, one of said legs including a pin extending normal thereto, the other said leg comprising an aperture for lockingly receiving said pin therein.

8. A retainer as set forth in claim 1 wherein said body is formed of a resilient plastic.

9. A retainer as set forth in claim 2 wherein said body is formed of a resilient plastic.

10. A retainer as set forth in claim 3 wherein said body is formed of a resilient plastic.

11. A retainer as set forth in claim 4 wherein said body is formed of a resilient plastic.

12. A retainer as set forth in claim 5 wherein said body is formed of a resilient plastic.

13. A retainer as set forth in claim 6 wherein said body is formed of a resilient plastic.

14. A retainer as set forth in claim 7 wherein said body is formed of a resilient plastic.

* * * * *